US005152522A

United States Patent [19]

Yamashita

[11] Patent Number: 5,152,522

[45] Date of Patent: Oct. 6, 1992

[54] SHEETLIKE ARTICLE CONVEYING ROLLER ASSEMBLY

[75] Inventor: Miyuki Yamashita, Tokyo, Japan

[73] Assignee: Hirakawa Kogyosha Co., Ltd., Tokyo, Japan

[21] Appl. No.: 693,571

[22] Filed: Apr. 30, 1991

[51] Int. Cl.[5] ..... B65H 5/06

[52] U.S. Cl. ..... 271/264; 271/161; 271/188; 271/209; 271/272; 226/185

[58] Field of Search ..... 271/161, 188, 209, 272, 271/264; 226/185

[56] References Cited

U.S. PATENT DOCUMENTS 4,089,378 5/1978 Suzuki ..... 271/272 X 4,589,650 5/1986 Miyoshi ..... 271/188 X

FOREIGN PATENT DOCUMENTS 31950 2/1988 Japan ..... 271/272

*Primary Examiner*—Richard A. Schacher

*Attorney, Agent, or Firm*—Oblon, Spivak, McClelland, Maier & Neustadt

[57] ABSTRACT

A sheetlike article conveying roller assembly comprises at least one rotary shaft, a plurality of rollers mounted on the rotary shafts at an optional positions, and a plurality of rings held on the rollers. The rollers on one of a pair of shafts are axially arranged in staggered position with those on the other shaft. The rings of the rollers on one of the pair of the rotary shaft and those on the rollers on the other rotary shaft overlap axially. A sheetlike article is conveyed by the rollers through a travelling path defined between the rotary shafts.

9 Claims, 3 Drawing Sheets

SHEETLIKE ARTICLE CONVEYING ROLLER ASSEMBLY

BACKGROUND OF THE INVENTION

1. Background of the Invention

This invention relates to a conveying roller assembly for conveying a sheetlike article, such as a strip of a film, a strip of a photosensitive member in a process camera or a developing unit, or paper sheets in a copying machine or a facsimile system.

A plurality of sheetlike article conveying apparatuses have been incorporated in these machines as they are being automated. In a prior art apparatus for conveying a sheetlike article, the sheetlike article is conveyed with a contact pressure applied by a plurality of pairs of conveying rollers, which are in linear contact with one another and are rotated in opposite directions. Such pairs of the conveying rollers are cylindrical in shape and have a uniform diameter longitudinally.

If such a cylindrical roller is not uniform in its diameter, the sheetlike article would skew or meander, and would not be conveyed smoothly. Therefore the rollers should be manufactured with a very high precision, thereby causing increase in the manufacturing cost. In addition, since the rollers have very smooth surfaces, the sheetlike article would slip between the rollers, and would not be conveyed reliably.

In a developing unit, dispersed components of a developer or fixing liquid tend to stick on the feed rollers, which requires to detach the conveying rollers from the developing unit so as to be cleaned. Since the individual cylindrical rollers are heavy, the whole roller unit would be heavy enough to require a large cleaning device and a lot of manpower for the cleaning work. In addition, the sheetlike article is sometimes wound around the circumferential surface of the roller, resulting in jamming.

SUMMARY OF THE INVENTION

It is therefore an object of this invention to provide a sheetlike article conveying roller assembly which can convey the sheetlike article smoothly without skewing or meandering, prevent the winding of the sheetlike article around the conveying rollers, and be manufactured with an ordinary precision at a reduced cost.

According to a first aspect of this invention, there is provided a sheetlike article conveying roller assembly, comprising: at least one rotary shaft; a plurality of rollers mounted on said rotary shafts at optional positions, each of said rollers having a groove on an outer circumferential surface thereof; and a plurality of elastic rings, each fitted in said groove of each said roller and having an outer circumferential surface extending outwardly from said roller so as to come into contact with a sheetlike article to be conveyed.

According to a second aspect of the invention, a pair of said rotary shafts are located so as to define therebetween a travelling path for the sheetlike article. The rollers on one of said rotary shafts are axially arranged in staggered positions with those on the other rotary shaft. The rings held on the rollers on one of the pair shafts and those held on the rollers on the other rotary shaft axially overlap so that the sheetlike article is conveyed waving perpendicularly of the conveying direction.

The above and other advantages, features and additional object of this invention will be manifest to those versed in the art upon making reference to the following detailed description and the accompanying drawings in which several preferred embodiments incorporating the principles of this invention are shown in way of illustrative examples.

BRIEF DESCRIPTION OF THE DRAWINGS

FIG. 6(*b*) is a front view of the ring in contact with the sheetlike article;

DETAILED DESCRIPTION

Several embodiments of this invention will now be described with reference to FIGS. 1 through 12.

Figure 1:
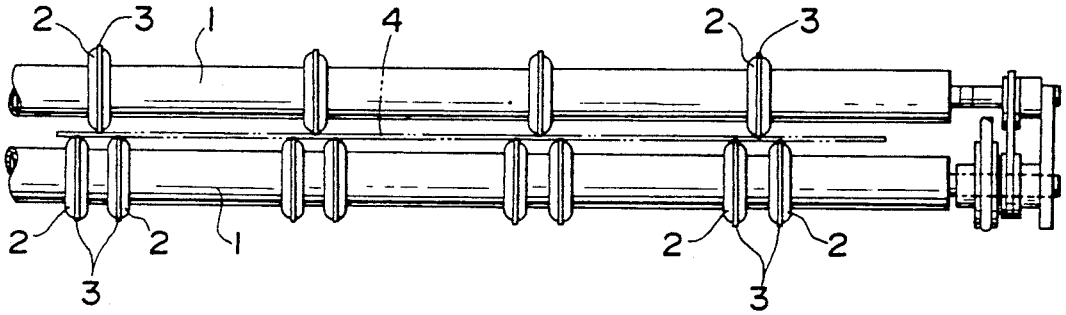
FIG. 1 is a front view of a sheetlike article conveying roller assembly according to one embodiment of this invention.
Figure 2:
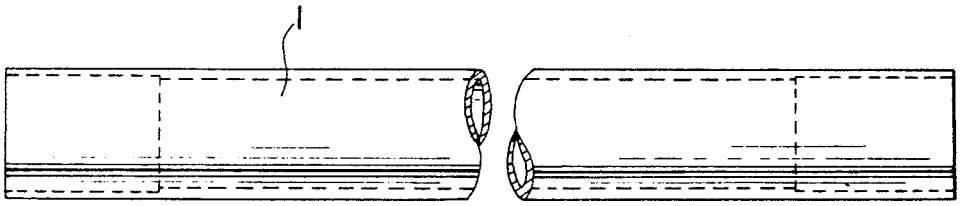
FIG. 2 is an enlarged front view of a rotary shaft of the conveying roller assembly of FIG. 1.

FIGS. 1 and 2 show a sheetlike article conveying roller assembly according to one embodiment of the invention. In FIG. 1, a pair of rotary shafts 1, 1 are rotated in opposite directions by a non-illustrated drive means such as a motor. Each of the rotary shafts 1, 1 has a plurality of rollers 5 disposed on its circumferential surface at a predetermined interval. Each of the rollers 2 holds a ring 3 on its outer circumferential surface. As shown in FIG. 2, the rotary shafts 1. 1 are light, hollow cylindrical members made of aluminum and coated with Alumilite (trade name).

Figure 3:
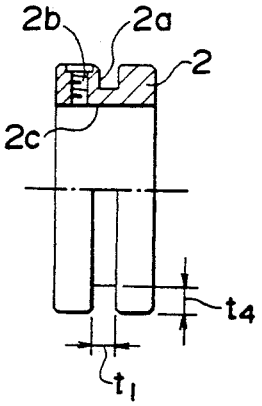
FIG. 3 is a partially enlarged cross-sectional front view of a roller.
Figure 4:
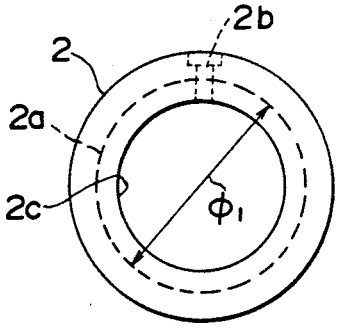
FIG. 4 is a side view of the roller of FIG. 3.
Figure 5:
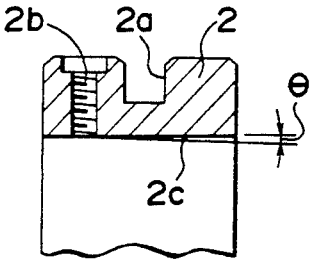
FIG. 5 is an enlarged cross-sectional view of the roller.

Each roller 2 has a groove 2*a* formed on its outer central circumferential surface, as shown in FIGS. 3 to 5. The roller 2 has an inner circumferential surface 2*c* which is tapered with an angle $\theta$ so that the roller 2 can fit smoothly on the rotary shaft 1. The roller 2 has on its outer circumferential surface a screw hole 2*b* formed radially near the groove 2*a*. The roller 2 is made of molded plastics, for example.

In FIGS. 3 and 4, $t_1$, $t_4$, and $\phi_1$ represent width, depth and bottom diameter of the groove 2*a*, respectively. Each roller 2 is mounted on the outer circumferential surface of the rotary shaft 1 in such a manner that the inner circumferential surface 2*c* of the roller 2 contacts the rotary shaft 1. Then the roller 2 is fixed on the rotary shaft 1 by a screw inserted via the screw hole 2*b*. The individual rollers 2 can be mounted on the rotary shaft 1 at optional positions.

Figure 7:
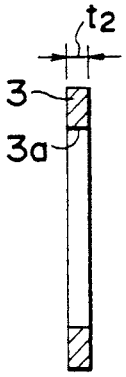
FIG. 7 is a cross-sectional front view of the ring.
Figure 8:
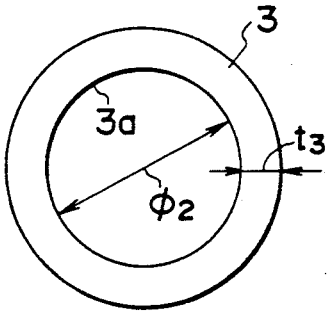
FIG. 8 is a top plan view of the ring.

As shown in FIGS. 7 and 8, each ring 3 is made of an elastic material such as rubber or the like, and fits, by its elasticity, in the groove 2*a* on the circumferential surface of the roller 2. In FIGS. 7 and 8, $t_2$ represents a width of the ring 3 in its axial direction, $t_3$: a thickness of the ring in the radial direction, and $\phi_2$: an inner diameter of the ring 3. $t_2$ is slightly larger than $t_1$ (the width of the groove 2*a*), $\phi_2$ is slightly smaller than $\phi_1$ (the bottom diameter of the groove 2*a*), and $t_3$ is a few millimeters larger than $t_4$ (the depth of the groove 2*a*). Therefore, an inner circumferential surface 3*a* of the ring 3 can fit in the groove 2*a*, so that the sides of the ring 3 closely contact with the opposite sides of the groove 2*a*. The outer circumferential surface of the ring 3 projects from the outer circumferential surface of the roller 2.

As shown in FIG. 1, a pair of the rotary shafts 1, 1 are located so as to define therebetween a travelling path for the sheetlike article 4. A plurality of the rollers 2 are mounted on the paired rotary shafts 1, 1, respectively. The number of the rollers 2 on the respective rotary shafts 1, 1 can be determined as desired. In the embodiment shown in FIG. 1, the number of the rollers 2 on one rotary shaft and that of the rollers on the other rotary shaft is in the ratio of 1:2. One of the shafts 1 has respective single rollers 2 mounted at an equal interval, while the other shaft 1 has several pairs of roller 2 mounted at an equal interval. In addition, the rollers 2 are arranged so that each single roller 2 on one of the shafts 1, 1 corresponds to each pair of rollers 2 on the other shaft 1. In other words, the rollers 2 on one of the pair of the shafts are axially arranged in staggered positions with those on the other shaft. The shafts 1, 1 are spaced so that the rings 3 of the rollers 5 on one shaft 1 and those on the other shaft 1 overlap axially.

In operation, when the pair of the shafts 1, 1 are rotated in opposite directions by a drive means such as a motor, the sheetlike article 4 is introduced into the travelling path. Then the respective rings 3 of the rollers 5 on the shafts 1, 1 come into contact with the upper and lower surfaces of the sheetlike article 4. The rings 3 move the sheetlike article 4 in their rotating directions. Since the rollers 2 on the pair of the rotary shafts 1, 1 are arranged as described above, the sheetlike article 4 is moved waving perpendicularly of the conveying direction, i.e. to the left and right in the plane shown in FIG. 1. Therefore sufficient force for conveying the sheetlike article 4 can be obtained.

Figure 6:
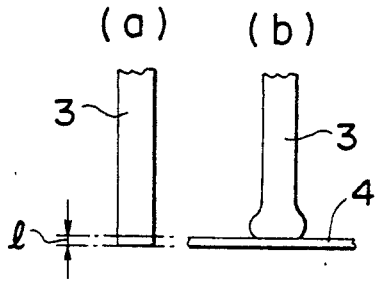
FIG. 6(*a*) is a front view of a ring out of contact with a sheetlike article.

FIGS. 6(*a*) and 6(*b*) show configurations of the ring 3 when it is out of contact with and in contact with the sheetlike article 4, respectively. When it is not in operation, the ring 3 is free and maintains its original shape as shown in FIG. 6(*a*). On the other hand, when it is in contact with the sheetlike article 4, the ring 3 is deformed elastically by the contact pressure with the sheetlike article 4, as shown in FIG. 6(*b*).

In this embodiment, the sheetlike article 4 in contact with the rings 3 is conveyed waving perpendicularly of the conveying direction. Therefore only a small contact pressure is enough to feed the sheetlike article 4 reliably. Since it is not necessary to have the sheetlike article 4 contacted with the whole longitudinal surface of the rollers contrary to the prior art apparatus, the conveying rollers can be made thin and light in weight. For example, if the shafts 1, 1 are hollow cylinders made of an aluminum material and the rollers 2 are of molded plastics the weight of the conveying roller assembly can be reduced to approximately one third of the prior art conveying apparatus. In addition, since only the rings 3 are contacted partially with the sheetlike article 4, the sheetlike article 4 would be less likely wound around the feed rollers and be free from jamming compared with the prior art apparatus.

The elastic rings 3 deform individually according to the contact pressure with the sheetlike article 4. Even when the shafts 1, 1, rollers 2 and rings 3 have slight dimensional variations, the rings 3 deform according to varying contact pressures with the sheetlike article 4, thereby allowing the sheetlike article 4 to be conveyed smoothly without skewing or meandering.

Figure 9:
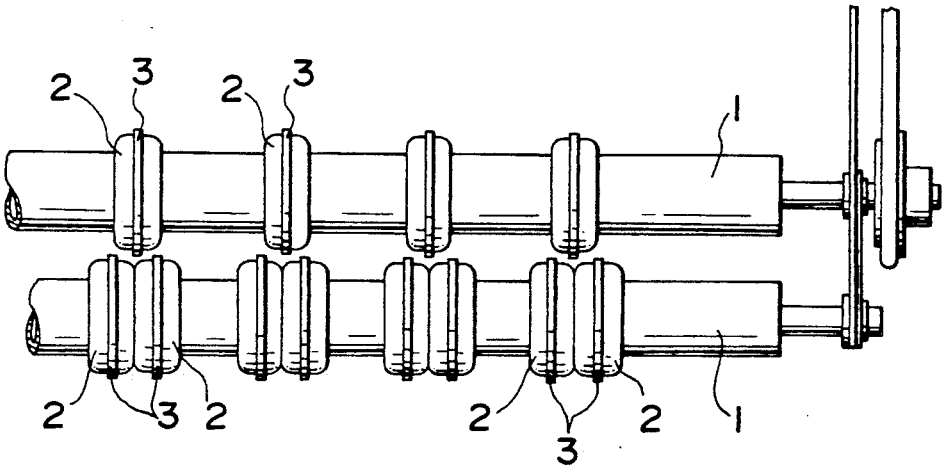
FIG. 9 is a front view of a sheetlike article conveying roller assembly according to another embodiment.

FIG. 9 shows a modified conveying roller assembly according to the embodiment of FIG. 1. This embodiment differs from the embodiment of FIG. 1 in that two rollers 2 in a pair are mounted side by side without any space between them. Each of individual rollers 2 on one shaft 1 is positioned so as to correspond to each pair of rollers 2 on the other shaft 1. This embodiment is as effective as the foregoing embodiment.

In the embodiment of FIG. 9, since the rollers 2 are positioned more closely one another on the shafts 1, 1 than the rollers 2 in the embodiment of FIG. 1, the sheetlike article 4 waves more frequently, thereby being moved with a more powerful conveying force.

In addition, the quantities, ratio and spaces of the rollers 2 on the respective shafts can be determined as desired. For example, in an embodiment shown in FIG. 10, the arrangement of the rollers 2 on the shafts 1, 1 is opposite to that of the embodiment shown in FIG. 1. In a still further embodiment of FIG. 11, each pair of rollers 2 on one shaft 1 is arranged so as to correspond to each second roller 2 on the other shaft 1.

Figure 10:
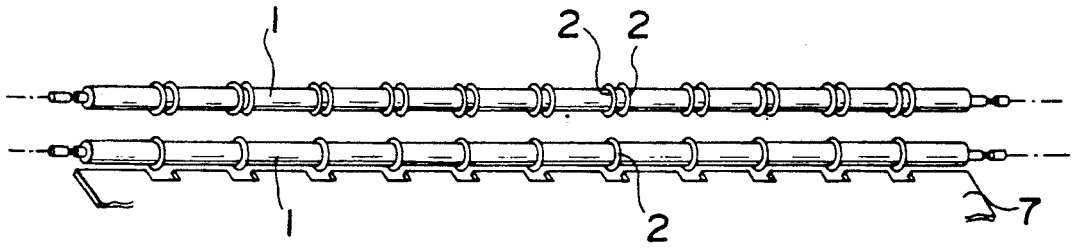
FIG. 10 is a front view of a sheetlike article conveying roller assembly according to a further embodiment.
Figure 11:
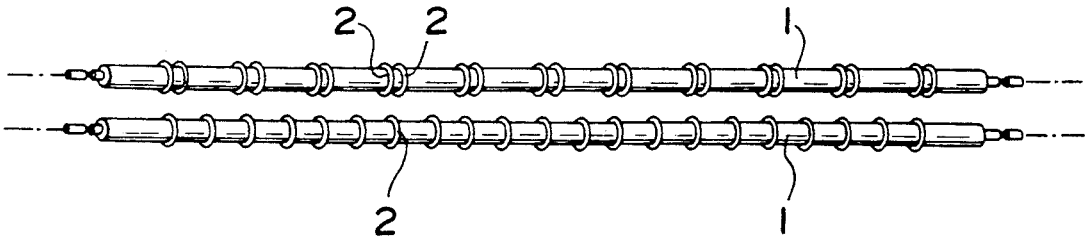
FIG. 11 is front view of a sheetlike article conveying roller assembly according to a still further embodiment.

In FIG. 10, reference numeral 7 represents a guide plate, which assists in guiding the sheetlike article 4 into the conveying rollers and forwarding the sheetlike article 4 from the conveying roller to a predetermined position. In the embodiment of FIG. 10, one side edge of the guide plate 7 is cut intermittently according to the positions of the rollers on the shaft 1. Specifically, the side edge of the guide plate 7 is cut at its portions facing the rollers and keeps its original shape at the portions facing the shaft 1. Therefore the guide plate 7 can be located very closely to one of the shafts 1, 1 by projecting the intermittently cut side edge under the shaft 1. The conveying roller assembly thus constructed can prevent the sheetlike article 4 from winding on the shafts and being jammed.

When the conveying rollers are cylindrical as in the prior art apparatus, the guide plate has to be located away from the sheetlike article conveying plane, and cannot prevent winding of the sheetlike article around the conveying rollers and jamming. For example, if the sheetlike article such as a film is jammed in a developing unit, not only the film but also the developing unit itself would be damaged. It would take a long time to restore the developing unit to its normal condition. The conveying rollers of this invention would obviate such inconveniences.

Figure 12:
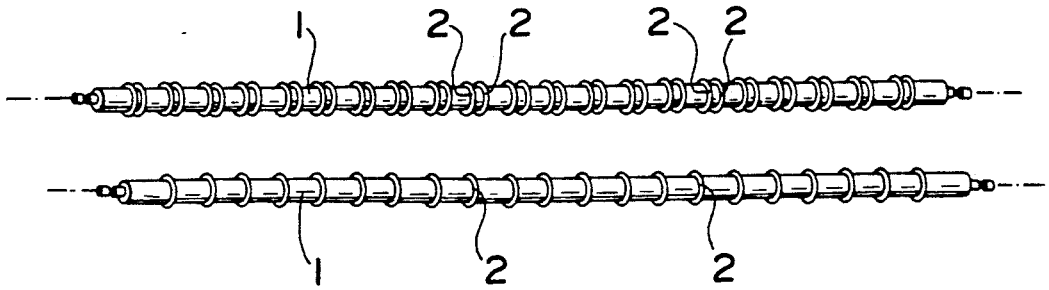
FIG. 12 is a cross-sectional view of a sheetlike article conveying apparatus according to a further embodiment.

In the embodiment shown in FIG. 12, each pair of rollers 2 is mounted at an interval on one of the pair of shafts 1, 1 while each single roller 2 is mounted on the other shaft at another interval, which is shorter than the first-mentioned interval. Then each second roller 2 on the second-mentioned shaft 1 is corresponds to each pair of rollers 2 on the first-mentioned shaft 1.

According to this invention, since the sheetlike article is conveyed by using the elasticity of the rings of the rollers, the conveying roller assembly is applicable to a variety of sheetlike articles not only such as a film or a photosensitive member in a process camera or an automatic developing apparatus but also such as paper sheets in a copying machine or a facsimile system. In addition, the conveying roller assembly is applicable to an inflexible sheetlike article such as a thin aluminum sheet. In such a case, the rings in rotation deform according to the contact pressure with the inflexible sheetlike article.

In the described embodiments, although one roller holds one ring on its outer circumferential surface, the roller can hold one or more rings. In such a case, the rings may have different degrees of hardness. Factors such as the quantity of rollers on one shaft, ratio of rollers on a pair of the shafts, hardness of the rings on respective rollers, and arrangement of the rollers on the respective shafts can be determined as desired depending upon quality, thickness, hardness and other characteristics of sheetlike articles to be carried.

In this sheetlike article conveying roller assembly, the elastic rings of the rollers on the rotary shafts are in partial contact with the sheetlike article to be conveyed. The conveying rollers are not required to be longitudinally in contact with the article to conveyed contrary to the prior art conveying rollers. Therefore the conveying roller assembly can be made light in weight. Since the elastic rings deform individually according to the contact pressure with the sheetlike article, the sheetlike article can be conveyed reliably even when there are slight dimensional variations in the rotary shafts, rollers or rings. In addition, the rollers on one of the pair of the rotary shafts and those on the other rotary shaft are arranged so as to overlap axially, thereby allowing the sheetlike article to be conveyed forcefully even if there is a small contact pressure between the rollers and the sheetlike article.

While the invention has been described by reference to specific embodiments chosen for purpose of illustration, it should be apparent that numerous modifications could be made thereto by those skilled in the art without departing from the basic concept and scope of the invention.

What is claimed is:

1. A sheetlike article conveying roller assembly comprising:

(a) a rotary shaft;

(b) a plurality of rollers mounted on said rotary shaft, said rollers being slidable axially along said shaft relative to one another so as to be positionable at optional positions, each of said rollers having a groove on an outer circumferential surface thereof; and (c) a plurality of elastic rings, each fitted in said groove of each said roller and having an outer circumferential surface extending outwardly from said roller so as to come into contact with a sheetlike article to be conveyed.

2. A sheetlike article conveying roller assembly according to claim 1, wherein each said roller holds said rings.

3. A sheetlike article conveying apparatus according to claim 2, wherein said rings have different degrees of hardness.

4. A sheetlike article conveying roller assembly according to claim 1, wherein a pair of said rotary shafts are located so as to define therebetween a travelling path for the sheetlike article.

5. A sheetlike article conveying roller assembly according to claim 4, wherein said rollers on one of said rotary shafts are axially arranged in staggered positions with those on the other said rotary shaft.

6. A sheetlike article conveying roller assembly according to claim 5, wherein said rings held on said rollers on one of said shafts and those held on said rollers on the other said rotary shaft axially overlap so that the sheetlike article is conveyed waving perpendicularly of the conveying direction.

7. A sheetlike article conveying roller assembly according to claim 1, wherein each of said plurality of rollers is positionable anywhere along said rotary shaft.

8. A sheetlike article conveying roller assembly according to claim 1, wherein each of said rollers includes a screw selectively tightenable against said shaft to prohibit axial movement from said optional positions.

9. A sheetlike article conveying roller assembly according to claim 1, wherein each of said rollers has an inner circumferential surface tapered at an angle $\theta$ relative to said rotary shaft.

* * * * *